US007311486B2

(12) United States Patent
Gorza et al.

(10) Patent No.: US 7,311,486 B2
(45) Date of Patent: Dec. 25, 2007

(54) CHARGING DEVICE WITH ROTARY CHUTE

(75) Inventors: Robert Gorza, Bofferdange (LU); Guy Thillen, Diekirch (LU)

(73) Assignee: Paul Wurth S.A., Luxembourg (LU)

( * ) Notice: Subject to any disclaimer, the term of this patent is extended or adjusted under 35 U.S.C. 154(b) by 596 days.

(21) Appl. No.: 10/498,575

(22) PCT Filed: Dec. 5, 2002

(86) PCT No.: PCT/EP02/13762

§ 371 (c)(1),
(2), (4) Date: Nov. 2, 2004

(87) PCT Pub. No.: WO03/050314

PCT Pub. Date: Jun. 19, 2003

(65) Prior Publication Data

US 2005/0063804 A1 Mar. 24, 2005

(30) Foreign Application Priority Data

Dec. 13, 2001 (LU) ..... 90 863

(51) Int. Cl.
*C21B 7/20* (2006.01)

(52) U.S. Cl. ..... 414/301; 414/206; 198/640; 198/641; 198/642; 198/536; 193/16; 193/23

(58) Field of Classification Search ..... 414/301, 414/206, 207; 198/536, 640, 641, 642; 193/16, 193/23

See application file for complete search history.

(56) References Cited

U.S. PATENT DOCUMENTS

| | | | | |
|---|---|---|---|---|
| 3,814,403 | A * | 6/1974 | Legille | 414/208 |
| 4,216,914 | A * | 8/1980 | O'Hanlon | 239/666 |
| 4,395,182 | A * | 7/1983 | Suwyn | 414/299 |
| 4,921,086 | A * | 5/1990 | Klutz et al. | 193/3 |
| 4,941,792 | A * | 7/1990 | Cimenti et al. | 414/208 |
| 5,022,806 | A * | 6/1991 | Lonardi et al. | 414/208 |
| 5,799,777 | A | 9/1998 | Maillet et al. | |
| 5,965,085 | A | 10/1999 | Abramin et al. | |
| 6,390,268 | B1 * | 5/2002 | Lonardi | 193/16 |

FOREIGN PATENT DOCUMENTS

JP 02034710 5/1990

(Continued)

OTHER PUBLICATIONS

Database WPI Section Ch, Week 198047 Derwent Publications Ltd., London, GB; Class M24, AN 1980-84060C XP002210891 & SU 727 690 A (DNEPR Metal Inst), Apr. 15, 1980 abstract.

(Continued)

*Primary Examiner*—Mark A Deuble
(74) *Attorney, Agent, or Firm*—McCormick, Paulding & Huber LLP

(57) ABSTRACT

A charging device for bulk material comprises a rotor having a substantially vertical axis of rotation a first drive for rotating the rotor and a chute supported by the rotor so as to be rotated with the latter. The chute can be rotated about its longitudinal axis. Its concavely curved sliding surface has a width that is diminishing from the top end to the bottom end of the chute, so that it is possible to vary the location where bulk material sliding down the chute channel leaves the latter by rotating the chute about its longitudinal axis.

17 Claims, 4 Drawing Sheets

FOREIGN PATENT DOCUMENTS

JP 02034711 5/1990

OTHER PUBLICATIONS

Database WPI Section Ch, Week 198122 Derwent Publications Ltd., London, GB; Class M24, AN 1981-39766D XP002210892 & SU 763 472 A (DNEPR Metal Wks), Sep. 15 1980 abstract.

Database WPI Section Ch, Week 198204 Derwent Publications Ltd., London, GB, Class M24, AN 1982-07549E XP002210893 & SU 821 492 A (W SIBE Metallurg Wk), Apr. 18, 1981 abstract.

Database WPI Section Ch, Week 198328 Derwent Publications Ltd., London, GB; Class M24, AN 1983-709548 XP002210890 & SU 954 422 A (DNEPR Metal Inst), Aug. 30, 1982 abstract.

* cited by examiner

CHARGING DEVICE WITH ROTARY CHUTE

CROSS-REFERENCE TO RELATED APPLICATION

This application is entitled to the benefit of and incorporates by reference in their entireties essential subject matter disclosed in International Application No. PCT/EP02/13762 filed on Dec. 5, 2002, and Luxembourg Patent Application No. 90 863 filed on Dec. 13, 2001.

FIELD OF THE INVENTION

The present invention relates to a charging device with a rotary chute.

BACKGROUND OF THE INVENTION

Charging devices with rotary chutes are inter alia used in shaft furnaces (such as e.g. modern blast furnaces) for providing a more or less uniform distribution of bulk material onto a charging surface inside the furnace. The chute defines for the charging material a chute channel with a concavely curved sliding surface. It is suspended in a cantilever manner from a rotor having a substantially vertical axis of rotation and can be pivoted on this rotor about a substantially horizontal suspension axis to change the inclination of the chute channel. By rotating the rotor about its vertical axis of rotation and simultaneously varying the inclination of the chute by means of a rotating pivoting mechanism, it is consequently possible to distribute the bulk material along a substantially spiral path onto a charging surface in the furnace.

Charging devices with rotary-pivoting chutes are for example described in WO 95/21272, U.S. Pat. No. 5,022,806, U.S. Pat. No. 4,941,792, U.S. Pat. No. 4,368,813, U.S. Pat. No. 3,814,403 and U.S. Pat. No. 3,766,868. In these prior art devices, the rotating pivoting mechanism comprises an auxiliary rotor, which has an axis of rotation substantially coaxial with the main rotor supporting the chute. While the main rotor rotates the chute about a vertical axis, the auxiliary rotor interacts with the rotating chute so as to pivot it about a horizontal suspension axis, thereby varying the inclination of the chute. For this purpose, the auxiliary rotor is connected to the chute by a mechanism converting e.g. a variation in angular displacement between the two rotors into a variation in the angle of inclination of the chute.

It will be appreciated that in prior art charging devices with rotary-pivoting chutes, the pivoting mechanism, used to vary the inclination of the chute channel has to transmit important pivoting moments onto the rotary chute. Indeed, the chute may have a cantilever length several meters, and due to heavy wear and heat protection, it is generally a very heavy construction. It follows that the pivoting mechanism of the rotary chute must be conceived to transmit important pivoting moments onto the rotating chute, which creates a lot of technical problems and makes the charging device rather expensive.

SU-954422 A discloses a charging device with a rotor rotated about a vertical axis of rotation and a chute supported by the rotor. This chute consists of half of a hollow cylinder with a support journal at its top end that is coaxial to the axis of the cylinder. This support journal is connected to an oscillation mechanism on rotor, so that the latter is capable of oscillating the chute about the axis of the cylinder. The bottom end of the chute is cut along a helical line, with half of the pitch equal to 35-50% of the furnace top diameter, leaving a pointed edge end. It will be noted that the chute disclosed in this document is a very cumbersome device that is not really suited for distributing bulk material along a substantially spiral path onto a surface.

SU-954422 A discloses a charging device with a rotor rotated about a vertical axis of rotation and a chute supported by the rotor. This chute consists of half of a hollow cylinder with a support journal at its top end that is coaxial to the axis of the cylinder. This support journal is connected to an oscillation mechanicanism on rotor, so that the latter is capable of oscillating the chute about the axis of the cylinder. The bottom end of the chute is cut along a helical line, with half of the pitch equal to 35-50% of the furnace top diameter, leaving a pointed edge end. It will be noted that the chute disclosed in this document is a very cumbersome device that is not really suited for distributing bulk material along a substantially spiral path onto a surface.

OBJECT OF THE INVENTION

A technical problem underlying the present invention is to provide a charging device capable of distributing bulk material along a substantially spiral path onto a surface, without having to transmit important pivoting moments onto a rotary chute.

This problem is solved by a charging device as claimed in claim 1.

SUMMARY OF THE INVENTION

A charging device for bulk material in accordance with the present invention comprises a rotor supported by a support structure so as to have a substantially vertical axis of rotation, a first drive for rotating the rotor about its substantially vertical axis of rotation and a chute supported by the rotor so as to be rotated with latter. This chute has a top end and a bottom end and defines for the bulk material a channel with a concavely curved sliding surface sloping downwards from the top end to the bottom end of the chute. In accordance with the present invention, the chute is supported by the rotor so as to be rotatable about its longitudinal axis, and its concavely curved sliding surface has a width that diminishes from the top end to the bottom end of the chute. By simply rotating this chute about its longitudinal axis, it is possible to vary the location where bulk material sliding down the chute channel leaves the latter. By rotating the rotor about its axis of rotation and simultaneously varying the angular orientation of the narrowing sliding surface by rotating the chute about its longitudinal axis, it is consequently possible to distribute bulk material along a substantially spiral path onto a surface. It will be appreciated that—in contrast to pivoting a cantilever chute about a horizontal axis of suspension—rotating a cantilever chute about its longitudinal axis does not require the transmission of important moments onto the chute, as the vertical position of the centre of gravity of a chute that is rotated about its longitudinal axis is not (or at least not substantially) changed.

The chute is rotatable about its longitudinal axis between a first angular end position and a second angular end position, wherein the amplitude of rotation of the chute between its two end positions is preferably less than 180° and more preferably about 90°. It will be appreciated that—due to a small amplitude of rotation—it is possible to have a relatively simple drive for rotating the chute about its longitudinal axis.

A front end edge delimits the sliding surface at the bottom end of the chute, and a first lateral edge delimits the sliding surface along one side from the bottom end to the top end of the chute. This first lateral edge is designed so that:

if the chute is in its first angular end position, then bulk material sliding down the chute channel leaves the latter over the front end edge; and if the chute is in its second angular end position, then bulk material sliding down the chute channel leaves the latter over the lateral edge, near the top end of the chute.

The concavely curved sliding surface is a substantially cylindrical surface. This allows to warrant that bulk material sliding down the chute channel always encounters substantially the same sliding conditions in the chute channel, independently of the angular orientation of the sliding surface.

It will be further appreciated that a simple an efficient solution for supporting the chute on the rotor is provided too. In accordance with this solution, the rotor comprises a rotatable support ring with an axis of rotation that defines an acute angle ($\alpha$) with the vertical axis of rotation of the rotor. The chute has a tubular top end that is axially inserted into the rotatable support ring and secured to the latter, wherein the longitudinal axis of the chute is substantially coaxial with the axis of rotation of the rotatable support ring. In this embodiment, complementary bayonet connection means are advantageously associated with the tubular top end and the rotatable support ring for axially supporting the tubular top end of the chute in the rotatable support ring. It will be appreciated that this bayonet type connection allows easy mounting and dismounting of the chute.

The charging device normally includes an hydraulic or electric second drive for rotating the chute about its longitudinal axis. This second drive is preferably mounted on the rotor and may be a rotary or linear drive. In a first embodiment with an hydraulic drive, the charging device comprises a rotating hydraulic connection for connecting the hydraulic drive on the rotor to a stationary hydraulic circuit on the support structure. In a second embodiment with an hydraulic drive, hydraulic power generating equipment is located on the rotor itself. In accordance with this solution, the charging device comprises an hydraulic pump with a pinion drive arranged on the rotor and a tooth ring fixed to the support structure. The pinion drive engages with the tooth ring and is driven by the latter when the rotor is rotated about its vertical axis of rotation. In a first embodiment with an electric drive, the charging device comprises slip ring contacts for connecting the electric drive to a stationary electric circuit. In a second embodiment with an electric drive, electric power generating equipment is located on the rotor itself. In accordance with this solution, the charging device comprises an electric generator with a pinion drive arranged on the rotor and a tooth ring fixed to the support structure. The pinion drive engages with the tooth ring and is driven by the latter when the rotor is rotated about its vertical axis of rotation. It has to be pointed out that the second drive could also be mounted on the support structure. In this case, the charging device includes e.g. an auxiliary rotor, which is driven by the second drive about a substantially vertical axis of rotation, and a mechanism connected between the auxiliary rotor and the chute, so that an angular shift between the auxiliary rotor and the rotor supporting the chute is transformed in a rotation of the chute about its longitudinal axis.

To convey bulk material onto the rotary chute, the rotor advantageously includes a vertical material feed tube in rotation with the rotor. This material feed tube has a top end for receiving the bulk material and a bottom end engaging the tubular top end of the chute for conducting the bulk material onto the concavely curved sliding surface on the top end of the chute. It will be noted that this solution allows to convey the bulk material through an entirely closed channel onto the chute. In this embodiment the support structure advantageously forms a housing including a top end with an top opening therein and a bottom end with a bottom opening therein. The vertical material feed tube is then located axially below the top opening in the housing, and the rotor forms a kind of rotating shield closing the bottom opening of the housing with the exception of a small annular gap between the rotor and the housing.

BRIEF DESCRIPTION OF THE DRAWINGS

The present invention will now be described, by way of example, with reference to the accompanying drawings, in which.

DETAILED DESCRIPTION OF A PREFERRED EMBODIMENT

Figure 1:
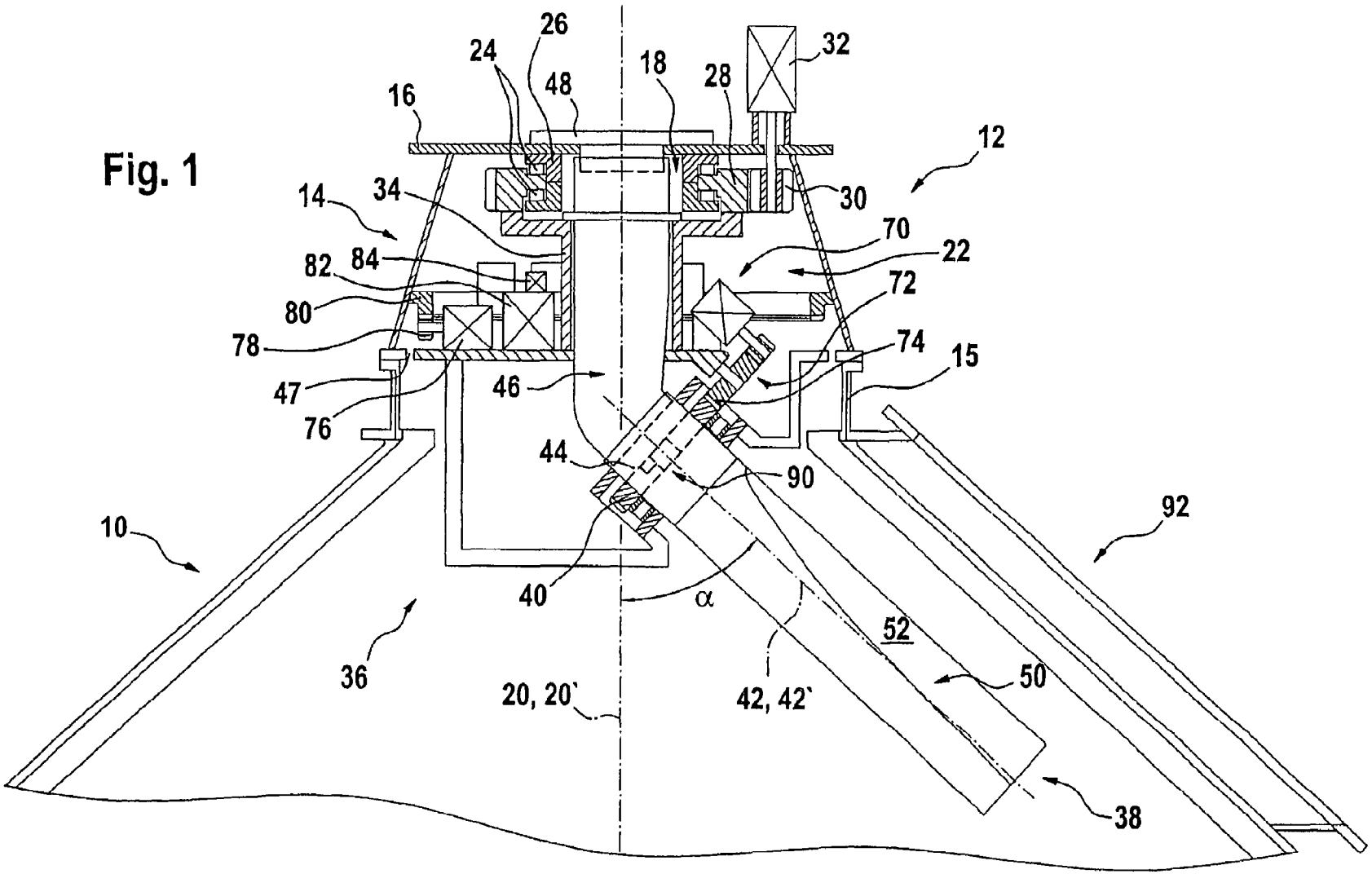
FIG. 1: is a schematic vertical section of a charging device in accordance with the present invention.

In FIG. 1, reference number 10 identifies a shaft furnace, as e.g. a blast furnace, that is equipped with a charging device 12 in accordance with the present invention. This charging device 12 comprises a support structure conceived as a housing 14, which is connected with its open bottom end to a top flange 15 of the shaft furnace 10. At its top end, the housing 14 is closed by a top plate 16 with an opening 18 centred on the vertical central axis 20 of the shaft furnace 10.

Reference number 22 globally identifies a rotor. The latter is supported inside the housing 14 by means of big diameter roller bearings 24. The latter are connected between the top end of the rotor 22 and a support flange 26 of the top plate 16, so that the rotor 22 has an axis of rotation 20' that is substantially coaxial to the vertical central axis 20 of the shaft furnace 10. The top end of the rotor 22 is furthermore equipped with a gear ring 28. A pinion 30 of a motor 32, which is mounted outside of the housing 14 on the top plate 16, engages this gear ring 28 for rotating the rotor 22 about its vertical axis of rotation 20'. A tubular body 34 extends the rotor 22 downwards, where its bottom end forms a support platform 36 for a chute 38.

To support the chute 38, the support platform 36 of the rotor 22 comprises a rotatable support ring 40, which has an axis of rotation 42 that defines an acute angle ($\alpha$) with the vertical axis of rotation 20 of the rotor 22. A tubular top end 44 of the chute 38 is axially inserted into the rotatable support ring 40 and secured thereto, so that the axis of rotation 42 of the rotatable support ring 40 is substantially coaxial with the longitudinal axis 42' of the chute 38, which passes through the centre of gravity of the chute 38. In summary, the chute 38 is supported by the rotor 22 so as to be rotatable about its longitudinal axis 40' without substantially changing the vertical position of the centre of gravity of the chute 38.

Reference number 46 identifies a vertical material feed tube. This material feed tube 46 is fixed to the rotor 22, so that it is in rotation with the latter. It includes an open top end arranged under the opening 18 in the top plate 16 and a bottom end engaging the tubular top end 44 of the chute 38. A stationary inlet funnel 48 is fixed onto the top plate 16 for charging the bulk material into the rotating material feed tube 46. It will further be noted that the support platform 36 of the rotor 22 is conceived as a kind of rotating annular shield surrounding the rotatable support ring 40 and closing the bottom opening of the housing 14 with the exception of a small annular gap 47 between the rotor 22 and the housing 14. This annular gap 47 allows to rotate the rotor 22 in the housing 14, but can be easily sealed off by adequate sealing means (not shown). Adequate sealing means (not shown) can also be provided between the bottom end of the material feed tube 46 and the tubular top end 44 of the chute 38, and between the stationary inlet funnel 48 and the top end of the material feed tube 46. It will therefore be appreciated that it is easily possible to obtain a very good protection of equipment inside the housing 14 against penetration of hot and corrosive gases from the furnace 10.

Figure 5:
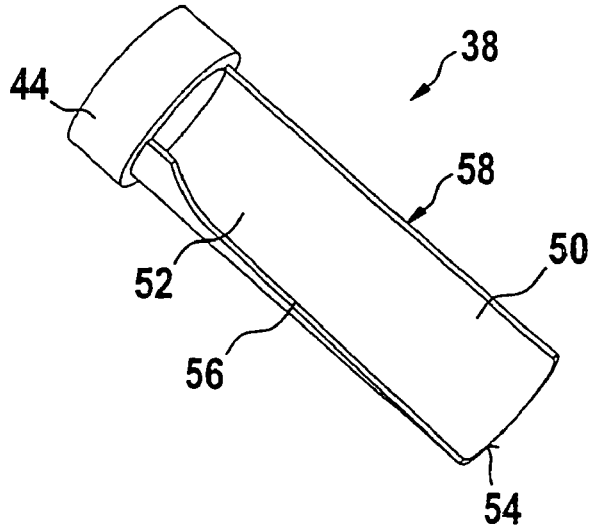
FIG. 5: is a three dimensional view of a chute for a charging device in accordance with the present invention.

Referring now simultaneously to FIG. 1 and FIG. 5, it will be noted that the chute 38 defines for the bulk material a channel 50 with a concave, cylindrical sliding surface 52 sloping downwards from the top end to the bottom end of the chute 38. The material feed tube 46 conveys the bulk material onto the sliding surface 52 in the tubular top end 44 of the chute 38. At the bottom end of the chute, the sliding surface 52 is delimited by a front edge 54. To its left side, the sliding surface 52 is delimited by a first lateral edge 56, and to its right side, by a second lateral edge 58. It will be noted that the first lateral edge 56 is de-signed so that the width of the concavely curved sliding surface 52 gradually diminishes from the top end to the bottom end of the chute 38.

Figure 2:
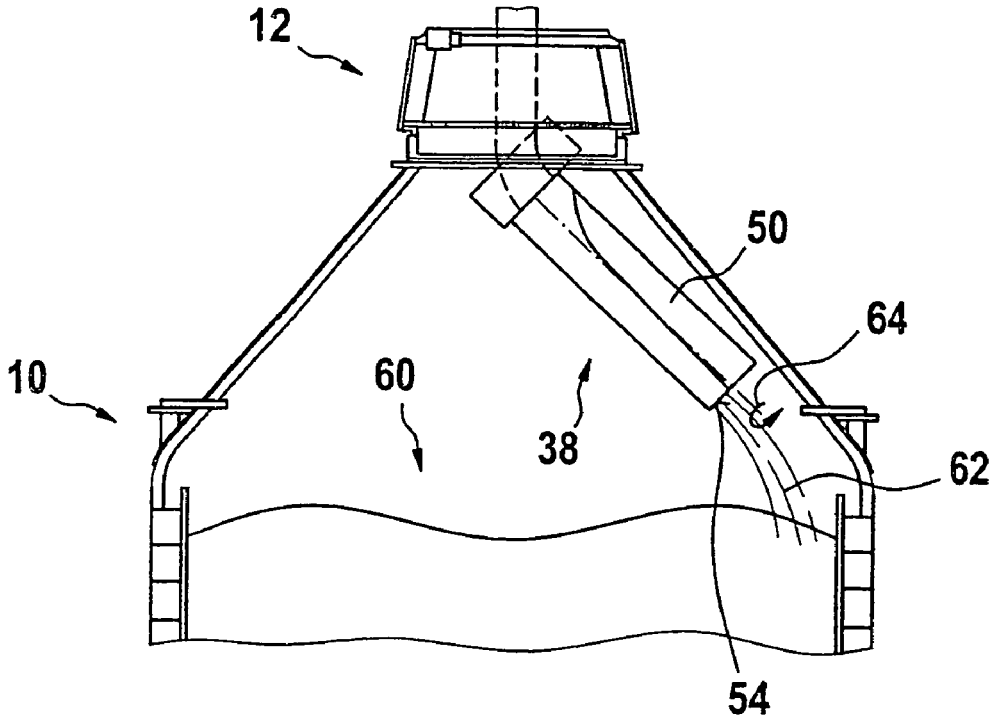
FIGS. 2-4: are sections of a top end of a shaft furnace equipped with a charging device in accordance with the present invention, which illustrate the operation of the charging device.
Figure 3:
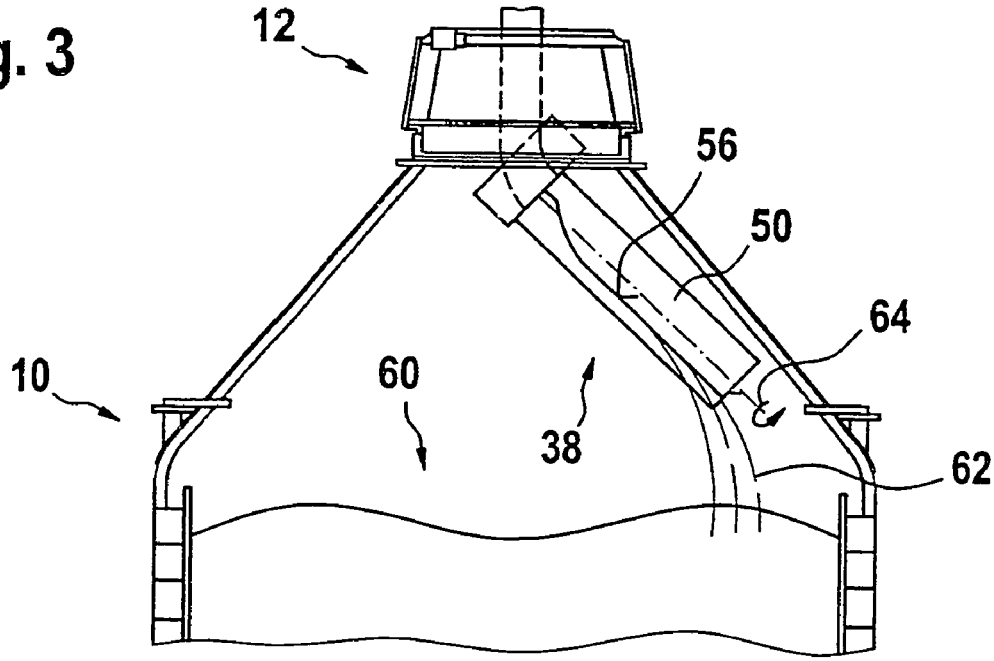
Figure 4:
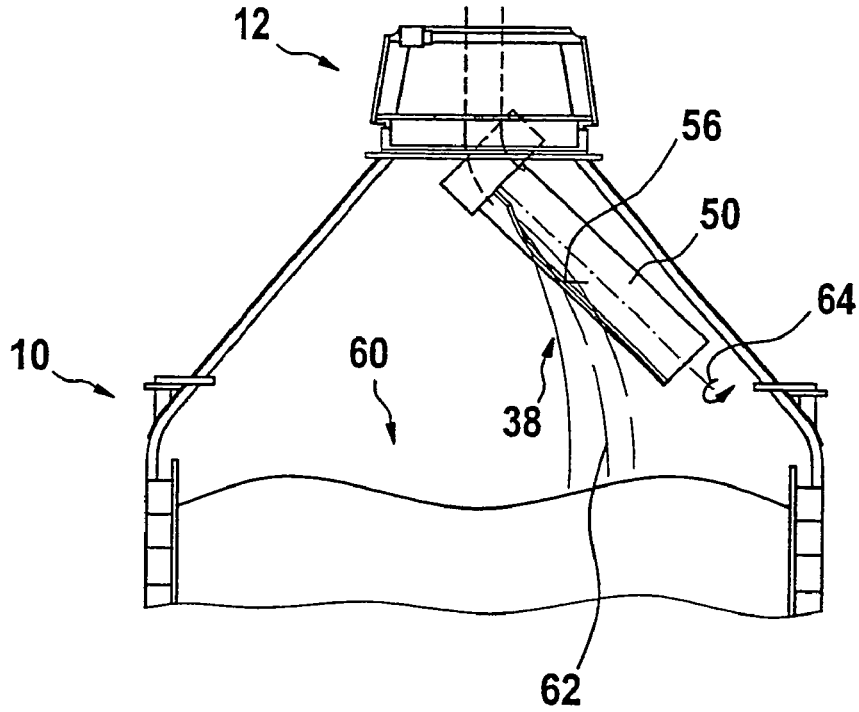

Referring now simultaneously to FIG. 2, FIG. 3 and FIG. 4, in which reference number 60 refers to a charging surface in the shaft furnace 10, the operation of the charging apparatus 12 will be readily understood. If the chute is in the position shown in FIG. 2, bulk material 62 sliding down the chute channel 50 leaves the latter at the bottom end of the chute 38, where it flows over the front edge 54 to fall onto the outer region of the charging surface 60. The chute 38 is now rotated about its central axis 40' in the direction of arrow 64 into the position of FIG. 3. If the sliding surface 52 has the angular orientation of FIG. 3, its first lateral edge 56 intersects the flow path of the bulk material sliding down the chute channel 50 near the bottom end of the chute 38. It follows that the bulk material 62 now leaves the chute channel 50 near the bottom end of the chute 38 by sliding over the first lateral edge 56. As a result, the bulk material 62 now falls closer to the centre of the charging surface 60. The chute 38 is then further pivoted about its central axis 40' in the direction of arrow 64 into the angular position of FIG. 4. If the sliding surface 52 has the angular orientation of FIG. 3, its first lateral edge 56 intersects the flow path of the bulk material sliding down the chute channel 50 already very close to the top end of the chute 38. It follows that the bulk material 62 now leaves the chute channel 50 near the top end of the chute 38 by sliding over the first lateral edge 56. As a result, the bulk material 62 now falls close to the centre of the charging surface 60. In FIG. 2, FIG. 3 and FIG. 4 the rotor 22 is always shown in the same position. It will be understood that by rotating the rotor 22 about its axis of rotation 20' and simultaneously varying the angular position of the chute 38 as described hereinbefore, it is possible to distribute bulk material 62 along a substantially spiral path onto the charging surface 60. It will be noted that the angular amplitude of the chute 38 between the end position shown in FIG. 2 and the end position shown in FIG. 4 can be very small (here it is about 90°).

The description of the charging device 12 will now be continued by referring again to FIG. 1. The rotatable support ring 40 of the chute 38 is driven by a second drive 70 mounted on the rotor 22. In the embodiment of FIG. 1, this second drive 70 is an electric or hydraulic rotary drive, which is connected to the rotatable support ring 40 by means of a gear assembly 72 engaging a gear ring 74 on the rotatable support ring 40. An interesting alternative to the gear assembly 72 is e.g. a chain drive. It will further be appreciated that—because of the small angular amplitude of the rotatable support ring 40—it is not excluded to conceive the second drive 70 as an electric or hydraulic linear drive, which is connected to the rotatable support ring 40 e.g. by means of a lever mechanism.

In the embodiment of FIG. 1, power supply equipment for the drive 70 is located on the rotor 22. If the drive 70 is e.g. an hydraulic drive, then reference number 76 represents an hydraulic pump arranged on the rotor 22 and provided with a pinion drive 78. The pinion drive 78 engages with a tooth ring 80 supported by the housing 14, so that the hydraulic pump 76 is driven by the tooth ring 80 when the rotor 22 is rotated about its vertical axis of rotation 20'. The pressure produced by the hydraulic pump 76 is accumulated in an hydraulic accumulator 82 arranged on the rotor 22. An hydraulic control circuit 84, which is connected between the hydraulic accumulator 82 and the hydraulic drive 70, allows to control the rotation of the chute 38 in function of control signals received from a central control unit (not shown). If the drive 70 is however an electric drive, then reference number 76 represents an electric generator arranged on the rotor 22 and provided with a pinion drive 78. The pinion drive 78 engages with the tooth ring 80 supported by the housing 14, so that the electric generator 76 is driven by the tooth ring 80 when the rotor 22 is rotated about its vertical axis of rotation 20'. The electric energy produced by the generator 76 is accumulated in an electric accumulator 82 arranged on the rotor 22. An electric control circuit 84, which is connected between the accumulator 82 and the electric drive 70, allows to control the rotation of the chute 38 in function of control signals received from a central control unit (not shown). It will be appreciated that these "power-supply-on-the-rotor" solutions have the advantage not to require a rotating power transfer system, such as e.g. electric slip ring contacts or rotating hydraulic connections, to connect the drive 70 to a stationary power supply.

A further advantage of the charging device 12 is the fact that the chute 38 can be easily mounted and dismounted. Referring again to FIG. 1, it will be noted that the tubular top end 44 of the chute 38 is in fact designed as a cylindrical tube that is axially inserted into a cylindrical opening of the rotatable support ring 40. Complementary bayonet connection means 90 are associated with the tubular top end 40 and the rotatable support ring 40 for axially supporting the tubular top end 44 of the chute 38 in the rotatable support ring 40. It follows that the chute 38 can be easily fixed (or unfixed) in its support ring 40 by rotating the rotatable support ring 40 about its central axis 42, while simultaneously blocking the chute 38 in rotation about its longitudinal axis 42'. Additional wedges or bolts (not shown) will normally be used to secure the bayonet type connection, thus avoiding its loosening when the chute 38 is rotated about its longitudinal axis 42 during operation of the charging device.

Figure 6:
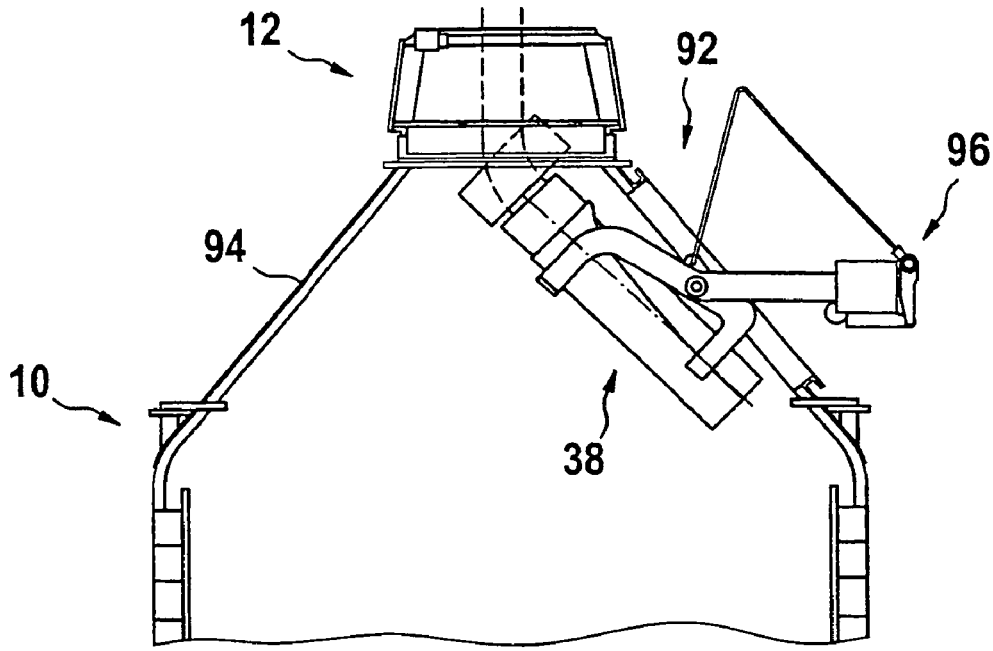
FIGS. 6-7: are sections of a top of a shaft furnace equipped with a charging device in accordance with the present invention, which illustrate a replacement of the chute.
Figure 7:
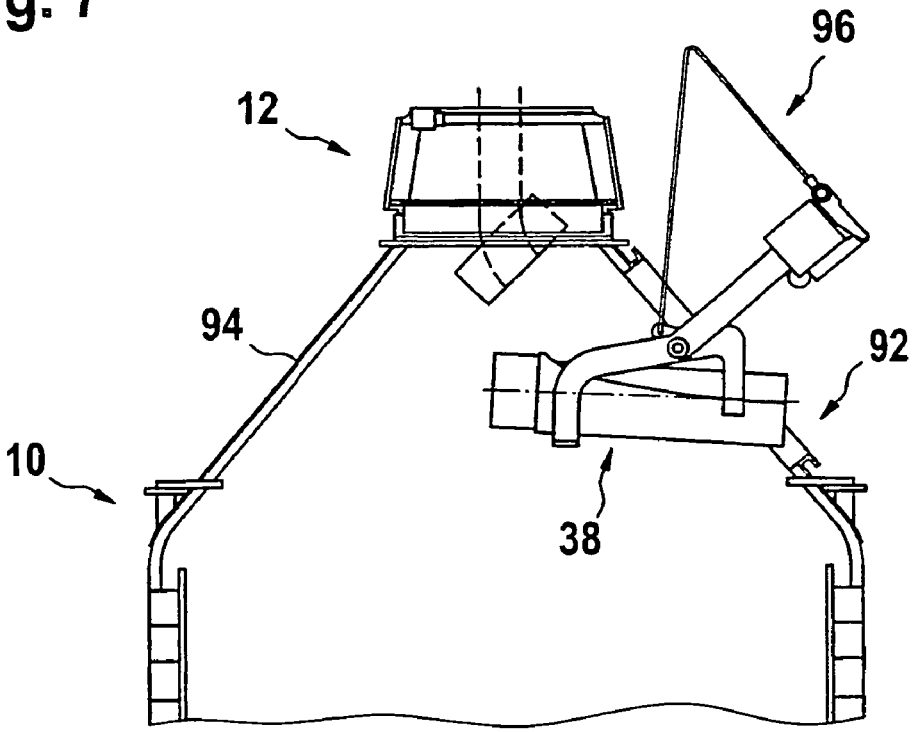

FIG. 6 and FIG. 7 illustrate the dismounting, respectively mounting, of the chute 38 through a maintenance opening 92 in a dome 94 at the top end of the shaft furnace 10 by means of a special chute manipulator 96. It will be noted that this chute manipulator 96 is also capable of blocking the chute 38 in rotation about its longitudinal axis 42' when the bayonet connection means 90 are to be locked or unlocked by rotating the rotatable support ring 40 about its central axis 42.

The invention claimed is:

1. A charging device for bulk material comprising:

a support structure;

a rotor supported by said support structure so as to have a substantially vertical axis of rotation;

a first drive for rotating said rotor about its substantially vertical axis of rotation; and a chute supported by said rotor so as to be rotated with the latter and to be rotatable about a longitudinal axis between a first angular end position and a second angular end position, said chute having a top end and a bottom end and defining for said bulk material a channel with a concavely curved substantially cylindrical sliding surface sloping downwards from said top end to said bottom end of said chute;

wherein said sliding surface has a front end edge delimiting said sliding surface at said bottom end of said chute and a first lateral edge delimiting said sliding surface along one side from said bottom end to said top end of said chute; and said first lateral edge is designed so that:

if said chute is in said first angular end position, then bulk material sliding down said chute channel leaves the latter over said front end edge; and if said chute is in said second angular end position, then bulk material sliding down said chute channel leaves the latter over said first lateral edge, near said top end of said chute.

2. The charging device as claimed in claim 1, wherein the amplitude of rotation between said first angular end position and said second angular end position is less than 180°.

3. The charging device as claimed in claim 1, wherein:

said rotor comprises a rotatable support ring with an axis of rotation that defines an acute angle with the vertical axis of rotation of said rotor; and said chute has a tubular top end that is axially inserted into said rotatable support ring and secured thereto, wherein said longitudinal axis of said chute is substantially coaxial with said axis of rotation of said rotatable support ring.

4. The charging device as claimed in claim 3, wherein:

said tubular top end of said chute is designed as a cylindrical tube that is axially inserted into a cylindrical opening of said rotatable support ring; and complementary bayonet connection means are associated with said tubular top end and said rotatable support ring for axially supporting said tubular top end of said chute in said rotatable support ring.

5. The charging device as claimed in claim 1, comprising a second drive mounted on said rotor for rotating said chute about its longitudinal axis.

6. The charging device as claimed in claim 5, wherein said second drive is an hydraulic drive and said charging device further comprises a rotating hydraulic connection for connecting said hydraulic drive on said rotor to a stationary hydraulic circuit on said support structure.

7. The charging device as claimed in claim 5, wherein said second drive is an hydraulic drive and said charging device further comprises:

an hydraulic pump arranged on said rotor, said hydraulic pump comprising a pinion drive;

a tooth ring fixed to said support structure, said pinion drive engaging with said tooth ring and being driven by the latter when said rotor is rotated about said vertical axis of rotation;

an hydraulic accumulator arranged on said rotor and connected to said hydraulic pump; and an hydraulic control circuit connected between said hydraulic accumulator and said hydraulic drive.

8. The charging device as claimed in claim 5, wherein said second drive is an electric drive and said charging device further comprises slip ring contacts for connecting said electric drive to a stationary electric circuit.

9. The charging device as claimed in claim 5, wherein said second drive is an electric drive and said charging device further comprises:

an electric energy generator arranged on said rotor, said electric energy generator comprising a pinion drive;

a tooth ring fixed to said support structure, said pinion drive engaging said tooth ring and being driven by the latter when said rotor is rotated about said vertical axis of rotation;

an electric energy accumulator arranged on said rotor and connected to said electric energy generator; and an electric control circuit connected between said electric energy accumulator and said electric drive.

10. The charging device as claimed in claim 1, further comprising:

a second drive mounted on said support structure;

an auxiliary rotor having a substantially vertical axis of rotation, said auxiliary rotor being driven by said second drive; and a mechanism connected between said auxiliary rotor and said chute, so that an angular shift between said auxiliary rotor and said rotor supporting said chute is transformed in a rotation of said chute about its longitudinal axis.

11. The charging device as claimed in claim 1, wherein:

said rotor includes a vertical material feed tube in rotation with said rotor; and said material feed tube includes a top end for receiving said bulk material and a bottom end engaging said top end of said chute for conducting said bulk material onto said concavely curved sliding surface on said top end of said chute.

12. The charging device as claimed in claim 11, wherein:

said support structure forms a housing including a top end with an top opening therein and a bottom end with an bottom opening therein;

said vertical material feed tube is located axially below said top opening in said housing; and said rotor closes said open bottom opening of said housing with the exception of a small annular gap between said rotor and said housing.

13. A charging device for bulk material comprising: a support structure;

a rotor supported by said support structure so as to have a substantially vertical axis of rotation;

a first drive for rotating said rotor about its substantially vertical axis of rotation;

a chute having a top end and a bottom end, said chute defining for said bulk material a channel with a concavely curved sliding surface sloping downwards from said top end to said bottom end of said chute;

a rotatable support ring supported by said rotor, said rotatable support ring having an axis of rotation that defines an acute angle with said vertical axis of rotation of said rotor, said chute having a tubular top end that is axially inserted into said rotatable support ring and secured thereto, so that said chute is rotatable about its longitudinal axis, wherein said sliding surface is designed so that it is possible to vary the location where bulk material sliding down said chute channel leaves the latter by rotating said chute about its longitudinal axis.

14. The charging device as claimed in claim 13, wherein:

said tubular top end of said chute is designed as a cylindrical tube that is axially inserted into a cylindrical opening of said rotatable support ring; and complementary bayonet connection means are associated with said tubular top end and said rotatable support ring for axially supporting said tubular top end of said chute in said rotatable support ring.

15. A charging device for bulk material comprising:

a support structure;

a rotor supported by said support structure so as to have a substantially vertical axis of rotation;

a first drive for rotating said rotor about its substantially vertical axis of rotation; and a chute supported by said rotor so as to be rotated with the latter and to be rotatable about a longitudinal axis between a first angular end position and a second angular end position, said chute having a top end and a bottom end and defining for said bulk material a channel with a concavely curved sliding surface sloping downwards from said top end to said bottom end of said chute, said sliding surface being designed so that it is possible to vary the location where bulk material sliding down said chute channel leaves the latter by rotating said chute about its longitudinal axis;

a hydraulic drive mounted on said rotor for rotating said chute about its longitudinal axis;

an hydraulic pump arranged on said rotor, said hydraulic pump comprising a pinion drive;

a tooth ring fixed to said support structure, said pinion drive engaging with said tooth ring and being driven by the latter when said rotor is rotated about said vertical axis of rotation;

an hydraulic accumulator arranged on said rotor and connected to said hydraulic pump; and an hydraulic control circuit connected between said hydraulic accumulator and said hydraulic drive.

16. A charging device for bulk material comprising:

a support structure;

a rotor supported by said support structure so as to have a substantially vertical axis of rotation;

a first drive for rotating said rotor about its substantially vertical axis of rotation; and a chute supported by said rotor so as to be rotated with the latter and to be rotatable about a longitudinal axis between a first angular end position and a second angular end position, said chute having a top end and a bottom end and defining for said bulk material a channel with a concavely curved sliding surface sloping downwards from said top end to said bottom end of said chute, said sliding surface being designed so that it is possible to vary the location where bulk material sliding down said chute channel leaves the latter by rotating said chute about its longitudinal axis;

an electric drive mounted on said rotor for rotating said chute about its longitudinal axis;

an electric energy generator arranged on said rotor, said electric energy generator comprising a pinion drive;

a tooth ring fixed to said support structure, said pinion drive engaging said tooth ring and being driven by the latter when said rotor is rotated about said vertical axis of rotation;

an electric energy accumulator arranged on said rotor and connected to said electric energy generator; and an electric control circuit connected between said electric energy accumulator and said electric drive.

17. A charging device for bulk material comprising:

a support structure;

a rotor supported by said support structure so as to have a substantially vertical axis of rotation;

a first drive for rotating said rotor about said substantially vertical axis of rotation; and a chute supported by said rotor so as to be rotated with the latter and to be rotatable about a longitudinal axis between a first angular end position and a second angular end position, said chute having a top end and a bottom end and defining for said bulk material a channel with a concavely curved sliding surface sloping downwards from said top end to said bottom end of said chute, said sliding surface being designed so that it is possible to vary the location where bulk material sliding down said chute channel leaves the latter by rotating said chute about its longitudinal axis;

wherein said rotor includes a vertical material feed tube in rotation with said rotor;

said material feed tube includes a top end for receiving said bulk material and a bottom end engaging said top end of said chute for conducting said bulk material onto said concavely curved sliding surface on said top end of said chute;

said support structure forms a housing including a top end with an top opening therein and a bottom end with an bottom opening therein;

said vertical material feed tube is located axially below said top opening in said housing; and said rotor closes said open bottom opening of said housing with the exception of a small annular gap between said rotor and said housing.

* * * * *